US005659849A

United States Patent [19]

Lindblad et al.

[11] Patent Number: 5,659,849

[45] Date of Patent: Aug. 19, 1997

[54] BIASED TONER COLLECTION ROLL FOR AN ULTRASONICALLY ASSISTED CLEANING BLADE

[75] Inventors: Nero R. Lindblad, Ontario; David B. Montfort, Webster; Christopher W. Curry, Rochester, all of N.Y.

[73] Assignee: Xerox Corporation, Stamford, Conn.

[21] Appl. No.: 675,200

[22] Filed: Jul. 3, 1996

[51] Int. Cl.[6] ..... G03G 21/00

[52] U.S. Cl. ..... 399/129; 399/349; 430/125

[58] Field of Search ..... 399/129, 349, 399/350, 354, 357; 430/125

[56] References Cited

U.S. PATENT DOCUMENTS

| | | | |
|---|---|---|---|
| 4,007,982 | 2/1977 | Stange | 355/15 |
| 4,111,546 | 9/1978 | Maret | 355/15 |
| 4,121,947 | 10/1978 | Hemphill | 134/1 |
| 4,833,503 | 5/1989 | Snelling | 355/259 |
| 5,030,999 | 7/1991 | Lindblad et al. | 355/297 |
| 5,500,969 | 3/1996 | Bonislawski, Jr. | 399/354 |
| 5,576,822 | 11/1996 | Lindblad et al. | 399/354 |

FOREIGN PATENT DOCUMENTS

| | | |
|---|---|---|
| 60-6977 | 1/1985 | Japan . |

*Primary Examiner*—Joan H. Pendegrass
*Attorney, Agent, or Firm*—T. L. Fair

[57] ABSTRACT

A method and apparatus for eliminating the accumulation of triboelectric negative toner that occurs between the cleaning edge of the cleaning blade and the photoreceptor surface. After image transfer, the residual toner particles on the photoreceptor surface are then charged to a uniform polarity using either a preclean corotron or a biased conductive blade. A UCA is used to dislodge the residual toner particles away from the photoreceptor surface. The polarity of the particles is opposite to that of the collection roll positioned to attract the toner particles levitated by the UCA onto the collection roll.

26 Claims, 3 Drawing Sheets

BIASED TONER COLLECTION ROLL FOR AN ULTRASONICALLY ASSISTED CLEANING BLADE

BACKGROUND OF THE INVENTION

This invention relates generally to an electrostatographic printer and copier, and more particularly, concerns a cleaning apparatus for removal of residual particles and agglomerates from an imaging surface.

A UCA (ultrasonic cleaner assist) device placed under a typical cleaning or spots blade reduces the friction of the urethane blade on the photoreceptor by creating an 'air bearing' effect. However, a problem with a 12 o'clock blade cleaner, in particular occurs as a result of toner collection in front of the cleaning blade.

The following disclosures may be relevant to various aspects of the present invention and may be briefly summarized as follows:

U.S. Pat. No. 5,030,999 to Lindblad et al. discloses a piezoelectric transducer (PZT) device operating at a relatively high frequency coupled to the backside of a somewhat flexible imaging surface to cause localized vibration at a predetermined amplitude, and is positioned in close association with the imaging surface cleaning function, whereby residual toner and debris (hereinafter referred to as simply toner) is fluidized for enhanced electrostatic discharge of the toner and/or imaging surface and released from the mechanical forces adhering the toner to the imaging surface.

U.S. Pat. No. 4,833,503 to Snelling discloses a multicolor printer using a sonic toner release development system to provide either partial or full color copies with minimal degradation of developed toner patterns by subsequent overdevelopment with additional colors and minimal back contamination of developer materials. After developing of the last color image, the composite color image is transferred to a copy sheet. Development is accomplished by vibrating the surface of a toner carrying member and thereby reducing the net force of adhesion of toner to the surface of the toner carrying member.

U.S. Pat. No. 4,121,947 to Hemphill discloses a charged residual toner removed by simultaneously (1) exposing the photoconductive layer of the photoreceptor to light, (2) charging the photoconductive layer to the same polarity as that of the toner, (3) vibrating the photoreceptor to dislodge the toner by entraining the photoreceptor to dislodge the toner by entraining the photoreceptor about a roller while rotating the roller about an eccentric axis, and subjecting the toner to a force (e.g. vacuum or gravity) which draws the toner away from the photoreceptor.

U.S. Pat. No. 4,111,546 to Maret discloses an electrostatographic reproducing apparatus and process including a system for ultrasonically cleaning residual material from the imaging surface. Ultrasonic vibratory energy is applied to the air space adjacent the imaging surface to excite the air molecules for dislodging the residual material from the imaging surface. Preferably pneumatic cleaning is employed simultaneously with the ultrasonic cleaning. Alternatively a conventional mechanical cleaning system is augmented by localized vibration of the imaging surface at the cleaning station which are provided from behind the imaging surface.

U.S. Pat. No. 4,007,982 to Stange discloses a cleaning apparatus, electrostatographic machine and process are provided wherein particulate material is removed from the surface of an electrostatographic imaging member by at least one blade member having an edge engaging the surface. The blade edge is vibrated at a frequency sufficiently high to substantially reduce the frictional resistance between the blade edge and imaging surface. The amplitude of the vibrations is controlled to a level which will insure sufficient conformity between the blade edge and the imaging surface so that adequate cleaning can be provided. Preferably the vibrations are carried out at ultrasonic frequencies with an amplitude less than about 0.005 inches.

SUMMARY OF INVENTION

Briefly stated, and in accordance with one aspect of the present invention, there is provided an apparatus for removing particles from a surface, comprising: means for cleaning the particles from the surface, the particles having a first charge and the cleaning means being biased to transfer a second charge to the particles creating particles with a first polarity; an ultrasonic cleaning assist device, positioned on the opposite side of the surface from the cleaning means and directly adjacent thereto, causing levitation of the particles on the surface away from the surface; and a biased collection roll for attracting the particles being levitated, with the first polarity, away from the surface onto the biased collection roll, having a second polarity, the biased collection roll being positioned in adjacent proximity to the cleaning means and the surface to attract the particles being levitated.

Pursuant to another aspect of the present invention, there is provided an apparatus for removing particles from a surface, comprising: a precleaning device biased to transfer a second charge to the particles having a first charge to create particles having a first polarity, means for cleaning the particles having a first polarity, from the surface; an ultrasonic cleaning assist device, positioned on the opposite side of the surface from the cleaning means and directly adjacent thereto, causing levitation of the particles on the surface away from the surface; and a biased collection roll for attracting the particles being levitated, with the first polarity, away from the surface onto the biased collection roll, having a second polarity, the biased collection roll being positioned in adjacent proximity to the cleaning means and the surface to attract the particles being levitated.

Pursuant to another aspect of the present invention, there is provided a method for eliminating the build up of toner particles on a surface between a cleaner and the surface, comprising: transferring an image to a media after development; biasing a conductive cleaning blade having a cleaning edge; removing the toner particles from the surface using the cleaning edge of the cleaning blade in contact with the surface; charging the particles remaining on the surface after image transfer to a first polarity by transferring charge from the conductive cleaning blade with bias to the particles; levitating the particles from the surface using an ultrasonic cleaning assist device in contact with the surface to cause vibratory energy to dislodge the particles accumulating on the surface at a contact region of the cleaning blade and the surface; attracting the toner particles, during levitation, to a biased collection roll having a second polarity different from the first polarity of the toner particles, positioned in adjacent proximity to the surface and the cleaning blade, to attract the toner particles onto the collection roll; and rotating the biased collection roll against a scraper blade to remove the toner particles from the biased collection roll into an auger.

Pursuant to another aspect of the present invention, there is provided a method for eliminating the build up of toner particles at a cleaning edge of a cleaning blade during removal of the toner particles from a moving surface, comprising: transferring an image to a media after development; biasing a preclean corotron; charging the particles remaining on the surface after image transfer to a first polarity by transferring charge from the preclean corotron with bias to the particles; removing the particles from the surface using the cleaning edge of the cleaning blade in contact with the moving surface; levitating the particles from the surface using an ultrasonic cleaning assist device in contact with the surface to cause vibratory energy to dislodge the particles accumulating on the surface at a contact region of the cleaning blade and the surface; attracting the toner particles, during levitation, to a biased collection roll having a second polarity different from the first polarity of the toner particles, positioned in adjacent proximity to the surface and cleaning blade, to attract the toner particles onto the collection roll; and rotating the biased collection roll against a scraper blade to remove the toner particles from the biased collection roll into an auger.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 4:
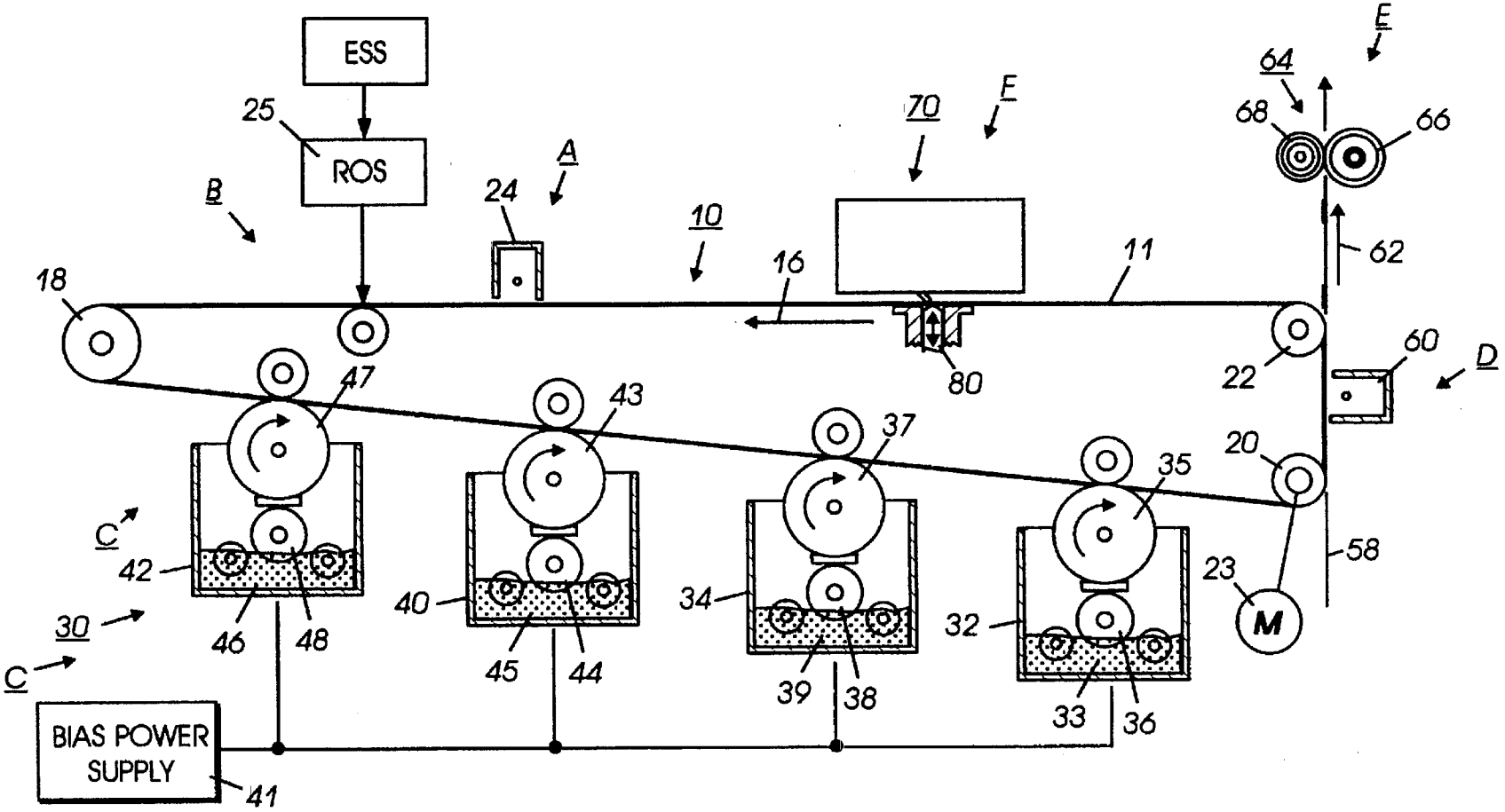
FIG. 4 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 4 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 4, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70.

Figure 1:
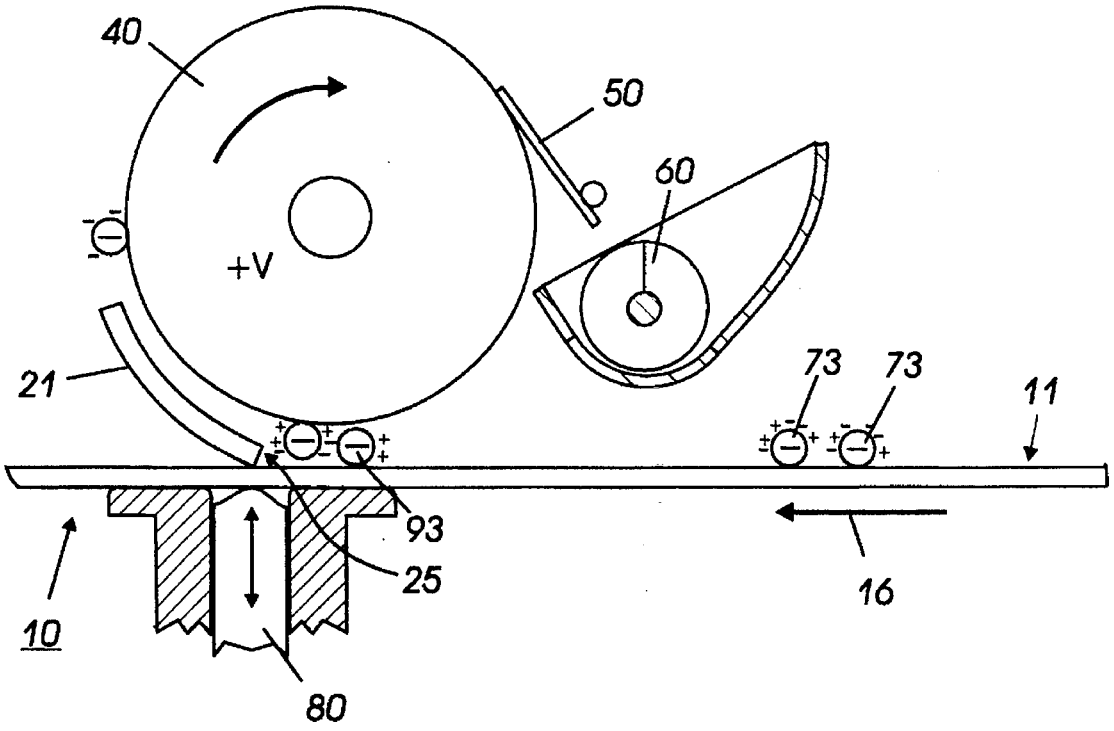
FIG. 1 is an elevational schematic of an initial experiment of the present invention.
Figure 2:
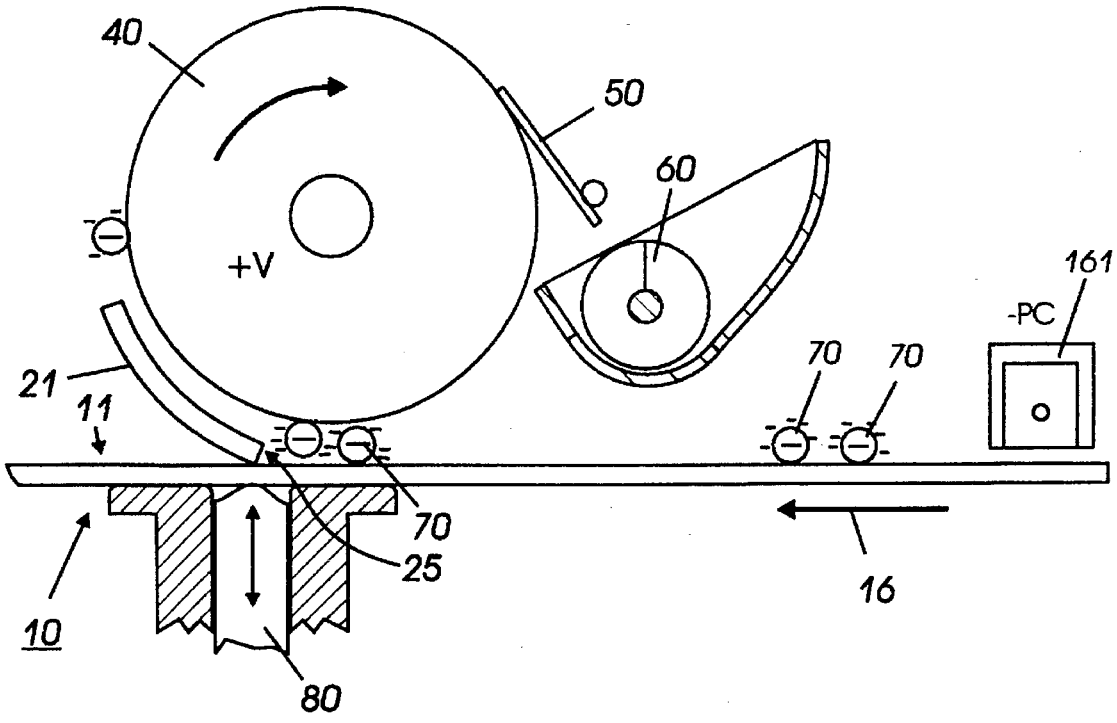
FIG. 2 is an elevational schematic of an embodiment of the present invention using a urethane blade cleaner and a negative preclean.
Figure 3:
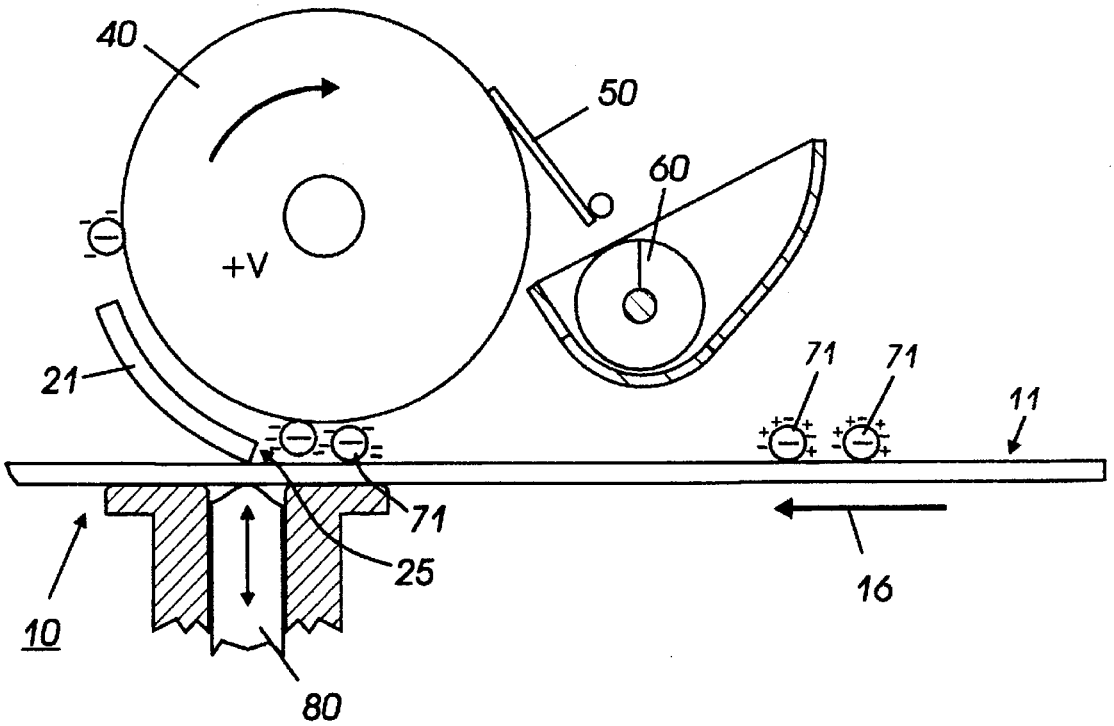
FIG. 3 is an elevational schematic of another embodiment of the present invention using a biased conductive cleaning blade and no preclean.

For a 12 o'clock cleaner configuration, where gravity cannot be employed to move the toner, the UCA (ultrasonic cleaning assist) in combination with the biased collection roll of the present invention is a novel method to remove residual toner in front of the blade. The UCA and biased collection roll also function in other architectures such as 3, 6 and 9 o'clock configurations. In these architectural configurations, the biased collection roll has an added advantage because it can be used to electrostatically seal the cleaner. The charged toner that falls away from the blade is captured by the biased collection roll. The location of the collection roll with respect to the cleaning edge of the blade and the photoreceptor surface depends on how gravity is moving the toner away from the cleaning edge. Usually in these blade cleaner configurations, gravity is employed to drop the toner into an auger or waste bottle, and the lower portion of the cleaner is mechanically sealed. The following references to FIGS. 1–3 show the present invention being used on triboelectric negative toner. However, the present invention is applicable to triboelectric positive toner by reversing the bias shown in FIGS. 1–3.

In the present invention, the ultrasonic cleaning assist (UCA) is used to dislodge the charged toner off the PR, and a biased collection roll is used to collect the dislodged charged toner. The proximity and position of the collection roll to the blade is important in order to collect the levitated charged toner and to electrostatically seal the cleaner.

Reference is now made to FIG. 1, which shows an elevational schematic of toner after transfer with a 12 o'clock cleaner. This illustrates an initial embodiment of the present invention. A standard urethane blade 20 is used to clean the charged triboelectric negative toner particles 73 from the photoreceptor surface 11. The toner charge distribution for these toner particles is essentially bipolar (–, +); the amount of positive and negative particles are about equal. When these particles are cleaned, they agglomerate and pile up in front of the cleaning edge 25. The UCA (ultrasonic cleaning assist) 80 cannot levitate these agglomerate particles as efficiently as it levitates individual particles. As more toner 73 collects in front of the blade 20, the excitation of the toner with the UCA is dampened. Therefore, the biased collection roll 46 has to be positioned in close proximity to the blade cleaning edge to collect the particles on the roll 40. Thus, it was determined that the collection roll 40 needed to be positioned approximately one half millimeter away from the cleaning edge of the blade 25. This proximity can create a tolerance problem between the blade 20 and the collection roll 40, and make manufacturing difficult and expensive. Thus, from this initial embodiment of the present invention, the importance of positioning and biasing was observed.

With continuing reference to FIG. 1, the collection roll 40 is positively biased and located adjacent to the cleaning edge 25 of the cleaning blade 20. The UCA 80 (ultrasonic cleaning assist) device, located on the opposite side of the photoreceptor 10 and adjacent to the cleaning blade 20 cleaning edge 25. The triboelectrically negative toner 73 is attracted to the positively biased collection roll 40 while the triboelectric toner particles 73 are in an agitated state due to the blade 20 and the UCA 80. A scraping blade 50 removes the toner particles 73 from the surface of the biased collection roll 40 and guides the particles 73 into an augered waste remover 60.

Reference is now made to FIG. 2, which shows an embodiment of the present invention using a preclean corotron. In FIG. 2, the bipolar toner, after transfer, is charged negative with the negative preclean 161. When the negative toner reaches the cleaning edge 25 of the blade 20, the negatively charged toner 70 starts to pile up at the cleaning edge. However, the charged toner pile can support only so much charge and then it explodes. This toner explosion is more dramatic when the excitation energy from the UCA 80 (ultrasonic cleaning assist) is applied. When the toner explosion is coupled with the UCA excitation energy, the explosion of charged toner is such that the collection roll 40 does not have to be in close proximity to the blade for the charged toner particles to be collected on the roll 40. Thus, there are dramatically reduced tolerance requirements for the distance between the blade and the collection roll. Without the UCA 80, the collection roll 40 is positioned 2 mm away from the cleaning edge 25, and with the excitation energy, the collection roll 40 can be positioned up to 4 mm away. The bias of the collection roll depends on the charge of the toner. When the toner is negatively charged, the bias used on the collection roll is positive (see FIGS. 1–3). When the toner charge is positive, the bias on the collection roll is negative (not shown).

With continuing reference to FIG. 2, the use of a preclean corotron device 161 to charge all of the particles 70 to one polarity prevents the problem encountered in initial experimentation in which only those particles and agglomerates of opposite charge were removed by the collection roll 40. This creates a toner pile in front of the blade which dampens the UCA excitation energy. A preclean treatment is required in the present invention, when a standard urethane material is used as the cleaning blade 20. Therefore, the addition of a preclean corotron 161 to make the toner charge one polarity is one embodiment of the present invention for preventing toner collection build up that may cause the cleaner to fail and create copy defects. Furthermore, in this embodiment, all the toner 70 is negatively charged and excited with the UCA 80, thus, it explodes more dramatically onto the collection roll 40, thus the proximity of the roll 40 is not as critical as in FIG. 1.

Reference is now made to FIG. 3, which shows an elevational schematic of the preferred embodiment of the present invention. A biased conductive blade 21 is used instead of standard urethane blade 20 (shown in FIGS. 1 and 2). This blade material can be a conductive urethane, a metal (such as steel), or a conductive plastic material. A variety of materials can be used for the cleaning blade 21 because the blade tip is energized using the UCA 80, thus, reducing the intimate contact of the cleaning edge with the photoreceptor 10, reducing the friction between the blade 21 and the photoreceptor 10, and essentially eliminating any abrasive action of the blade 21 on the photoreceptor 10. This significantly increases the field of potential blade materials.

With continuing reference to FIG. 3, the preclean corotron (shown in FIG. 2) is eliminated by using the biased conductive blade 21. The biased collection roll 40 is placed over the cleaning edge 25 of the conductively biased blade 21. The toner 71 on the collection roll 40 is removed with a scraper blade 50 and dropped into an auger system 60.

This is based on the phenomenon that negative charge elements, such as a biased conductive blade 21 can inject negative charge into triboelectric negative toner. The bipolar toner particles 71 are charged negative when they contact the negatively biased blade (for example, about −200 volts). These negatively charged toner particles 71 approach the front of the biased blade 21, and as a result of the accumulated charge, a toner explosion occurs in front of the blade directing the toner to the collection roll 40. As previously mentioned, this toner explosion which is further energized by using a UCA 80, enables the toner 71 in front of the conductive blade 21 to be sprayed more forcibly towards the collection roll 40 for collection and removal from the surface of the photoreceptor 10. Another advantage of the biased conductive blade is that it also improves the cleaning performance because the blade repels the toner.

In recapitulation, the present invention utilizes a biased collection roll and either a preclean corona device or a biased conductive cleaning blade to prevent the collection of toner particles at the cleaning edge of the cleaning blade. A preclean is required when a standard urethane material is used as the cleaning blade. In the embodiment of the present invention where a preclean device is used with a standard urethane cleaning blade, all the triboelectric negative toner is negatively charged and excited with the UCA, which explodes more dramatically onto the collection roll, thus, the proximity of the roll to the cleaning blade is not critical as initially observed in the initial embodiment in which neither a preclean device or biased conductive blade is used. The preferred embodiment of the present invention uses a biased conductive blade and thus does not require a preclean corona device. The negatively biased blade injects negative charge into the triboelectric negative toner. The charge injection phenomena occurs when the triboelectric negative toner contacts the negative conductive bias element. The present invention is applicable to triboelectric positive toner. When the toner is triboelectric positive, the preclean device or conductive blade would be biased positive and the collection roll would be negatively biased.

It is, therefore, apparent that there has been provided in accordance with the present invention, a biased toner collection roll for an ultrasonically assisted cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a surface, comprising:

means for cleaning the particles from the surface, the particles having a first charge and said cleaning means being biased to transfer a second charge to the particles creating particles with a first polarity;

an ultrasonic cleaning assist device, positioned on the opposite side of the surface from said cleaning means and directly adjacent thereto, causing levitation of the particles on the surface away from the surface; and a biased collection roll for attracting the particles being levitated, with the first polarity, away from the surface onto said biased collection roll, having a second polarity, said biased collection roll being positioned in adjacent proximity to said cleaning means and the surface to attract the particles being levitated.

2. An apparatus as recited in claim 1, wherein the second polarity having a difference in charge from the first polarity to enable attraction to occur between the particles being levitated, with the first polarity, and said collection roll with the second polarity.

3. An apparatus as recited in claim 2, wherein said cleaning means comprises a conductive blade.

4. An apparatus as recited in claim 3, wherein said conductive blade is biased negatively.

5. An apparatus as recited in claim 4, wherein the particles are triboelectric negatively charged.

6. An apparatus as recited in claim 5, wherein the first polarity is negative.

7. An apparatus as recited in claim 6, wherein the second polarity is positive.

8. An apparatus as recited in claim 3, wherein said conductive blade is biased positively.

9. An apparatus as recited in claim 8, wherein the particles are triboelectric positively charged.

10. An apparatus as recited in claim 9, wherein the first polarity is positive.

11. An apparatus as recited in claim 10, wherein the first polarity is negative.

12. An apparatus for removing particles from a surface, comprising:

a precleaning device biased to transfer a second charge to the particles having a first charge to create particles having a first polarity;

means for cleaning the particles having a first polarity, from the surface;

an ultrasonic cleaning assist device, positioned on the opposite side of the surface from said cleaning means and directly adjacent thereto, causing levitation of the particles on the surface away from the surface; and a biased collection roll for attracting the particles being levitated, with the first polarity, away from the surface onto said biased collection roll, having a second polarity, said biased collection roll being positioned in adjacent proximity to said cleaning means and the surface to attract the particles being levitated.

13. An apparatus as recited in claim 12, wherein said precleaning device is located upstream in the direction of motion of the surface from said cleaning means.

14. An apparatus as recited in claim 13, wherein the second polarity having a difference in charge from the first polarity to enable attraction to occur between the particles, with the first polarity, being levitated and said collection roll with the second polarity.

15. An apparatus as recited in claim 14, wherein said cleaning means comprises a non-conductive blade.

16. An apparatus as recited in claim 15, wherein the toner particles are charged opposite a charge of said biased collection roll being biased opposite that of the particles.

17. An apparatus as recited in claim 16, wherein said precleaning device is negatively biased.

18. An apparatus as recited in claim 17, wherein the particles are triboelectric negatively charged.

19. An apparatus as recited in claim 18, wherein the first polarity is negative.

20. An apparatus as recited in claim 19, wherein the second polarity is positive.

21. An apparatus as recited in claim 16, wherein said precleaning device is positively biased.

22. An apparatus as recited in claim 21, wherein the particles are triboelectric negatively charged.

23. An apparatus as recited in claim 22, wherein the first polarity is positive.

24. An apparatus as recited in claim 23, wherein the second polarity is negative.

25. A method for eliminating the build up of toner particles on a surface between a cleaner and the surface, comprising:

transferring an image to a media after development;

biasing a conductive cleaning blade having a cleaning edge;

removing the toner particles from the surface using the cleaning edge of the cleaning blade in contact with the surface;

charging the particles remaining on the surface after image transfer to a first polarity by transferring charge from the conductive cleaning blade with bias to the particles;

levitating the particles from the surface using an ultrasonic cleaning assist device in contact with the surface to cause vibratory energy to dislodge the particles accumulating on the surface at a contact region of the cleaning blade and the surface;

attracting the toner particles, during levitation, to a biased collection roll having a second polarity different from the first polarity of the toner particles, positioned in adjacent proximity to the surface and the cleaning blade, to attract the toner particles onto the collection roll; and rotating the biased collection roll against a scraper blade to remove the toner particles from the biased collection roll into an auger.

26. A method for eliminating the build up of toner particles at a cleaning edge of a cleaning blade during removal of the toner particles from a moving surface, comprising:

transferring an image to a media after development;

biasing a preclean corotron;

charging the particles remaining on the surface after image transfer to a first polarity by transferring charge from the preclean corotron with bias to the particles;

removing the particles from the surface using the cleaning edge of the cleaning blade in contact with the moving surface;

levitating the particles from the surface using an ultrasonic cleaning assist device in contact with the surface to cause vibratory energy to dislodge the particles accumulating on the surface at a contact region of the cleaning blade and the surface;

attracting the toner particles, during levitation, to a biased collection roll having a second polarity different from the first polarity of the toner particles, positioned in adjacent proximity to the surface and cleaning blade, to attract the toner particles onto the collection roll; and rotating the biased collection roll against a scraper blade to remove the toner particles from the biased collection roll into an auger.

* * * * *